US011433273B2

(12) United States Patent
Namiki

(10) Patent No.: US 11,433,273 B2
(45) Date of Patent: Sep. 6, 2022

(54) EXERCISE TOOL

(71) Applicant: Toshiki Namiki, Nagano (JP)

(72) Inventor: Toshiki Namiki, Nagano (JP)

( * ) Notice: Subject to any disclaimer, the term of this patent is extended or adjusted under 35 U.S.C. 154(b) by 2 days.

(21) Appl. No.: 17/138,635

(22) Filed: Dec. 30, 2020

(65) Prior Publication Data

US 2021/0213326 A1 Jul. 15, 2021

(30) Foreign Application Priority Data

Jan. 10, 2020 (JP) ..... JP2020-003214

(51) Int. Cl.

| | |
|---|---|
| ***A63B 22/18*** | (2006.01) |
| ***A63B 23/14*** | (2006.01) |
| ***A63B 23/08*** | (2006.01) |
| ***A63B 21/00*** | (2006.01) |

(52) U.S. Cl.

CPC ..... *A63B 22/18* (2013.01); *A63B 21/4015* (2015.10); *A63B 21/4019* (2015.10); *A63B 21/4034* (2015.10); *A63B 21/4035* (2015.10); *A63B 23/08* (2013.01); *A63B 23/14* (2013.01); *A63B 2022/185* (2013.01); *A63B 2209/08* (2013.01)

(58) Field of Classification Search

CPC . A63B 22/18; A63B 21/4015; A63B 21/4019; A63B 21/4034; A63B 21/4035; A63B 23/08; A63B 23/14; A63B 2022/185; A63B 2209/08; A63B 23/02; A63B 21/068; A63B 23/035; A63B 23/0488; A63B 23/1236; A63B 22/20–2022/206; A63B 26/003; A63B 22/16

See application file for complete search history.

(56) References Cited

U.S. PATENT DOCUMENTS

| | | | | |
|---|---|---|---|---|
| 10,583,321 | B2 * | 3/2020 | Panes | A63B 21/4033 |
| 11,027,170 | B2 * | 6/2021 | Carr | A63B 22/18 |
| 11,097,153 | B1 * | 8/2021 | Lee | A63B 22/18 |
| 2007/0298947 | A1 * | 12/2007 | Eksteen | A63B 22/20 482/141 |
| 2012/0252645 | A1 * | 10/2012 | Agostini | A63B 26/003 482/132 |
| 2013/0023391 | A1 * | 1/2013 | Nicholas | A63B 21/0004 482/132 |
| 2013/0116100 | A1 * | 5/2013 | Chen | A63B 26/003 482/146 |
| 2014/0038795 | A1 * | 2/2014 | Sassano | A63B 22/18 482/141 |
| 2014/0162859 | A1 * | 6/2014 | Cheng | A63B 26/003 482/142 |

(Continued)

FOREIGN PATENT DOCUMENTS

| | | |
|---|---|---|
| JP | 3162539 U | 9/2010 |

*Primary Examiner* — Jennifer Robertson
*Assistant Examiner* — Catrina A Letterman
(74) *Attorney, Agent, or Firm* — Studebaker & Brackett PC

(57) ABSTRACT

This invention includes: a base having a contact part that is in contact with a use surface; a movable part magnetically and detachably held above the base; a three-dimensionally movable support unit configured to support the movable part that is held by the base, in such a manner as to allow the movable part to move three-dimensionally and flexibly; and an attachment part via which the movable part is detachably attachable to a hand or a foot in a direct or indirect manner.

7 Claims, 9 Drawing Sheets

(56) References Cited

U.S. PATENT DOCUMENTS

| | | | | |
|---|---|---|---|---|
| 2018/0185702 | A1* | 7/2018 | Brown | A63B 22/20 |
| 2021/0162287 | A1* | 6/2021 | Xing | A63B 71/0622 |
| 2021/0268337 | A1* | 9/2021 | Shoffler | A63B 26/003 |

* cited by examiner

EXERCISE TOOL

This application is based on and claims the benefit of priority from Japanese Patent Application 2020-003214, filed on 10 Jan. 2020, the content of which is incorporated herein by reference.

BACKGROUND OF THE INVENTION

Field of the Invention

The present invention relates to an exercise tool used for physical exercises, muscle training, or the like in a state where the exercise tool is in contact with a use surface, such as a paved surface or a floor surface.

Related Art

A conventional exercise tool used for muscle training and/or health promotion includes a plate-like member that is placed on a floor surface so as to be slidable along the floor surface in one direction. During use, a user puts his/her feet on the plate-like member, and moves his/her body and limbs to slide the plate-like member.

For example, Patent Document 1 discloses a fitness tool including a long plate that is placed on a floor surface and a pair of foot placing plates provided to an upper surface of the long plate via rails in a horizontally slidable manner. A user can perform an exercise of opening and closing his/her legs by causing the foot placing plates to slide in a left-right direction with his/her feet. With this fitness tool, while lying face down with his/her hands placed on one of the foot placing plates and his/her knees placed on the other of the foot placing plates, the user can flex and extend his/her lower back by causing the foot placing plates to slide in a front-back direction, so as to perform an abdominal muscle training.

Patent Document 1: Japanese Unexamined Utility Model (Registration) Application Publication No. 3162539

SUMMARY OF THE INVENTION

With the fitness tool described in Patent Document 1, the motion of the hands and feet is limited to the ones taken place along the sliding direction of the foot placing plates. Therefore, parts of the body subjected to the load are limited. The limited variation in exercises and muscle training may sometimes dissatisfy the user. In addition, in a state where the foot placing plates are stopped, it is difficult to use the fitness tool for dynamic muscle training involving a motion of the wrist(s) and/or ankle(s), although the fitness tool can be used for static muscle training, such as holding the posture with which a load is applied to a specific part of the body. Therefore, there has been a demand for an exercise tool that enables wide variations in exercises and muscle training even in a state where the exercise tool is stopped.

In view of this, an object of the present invention is to provide an exercise tool that enables wide variations in exercises and muscle training even in a state where the exercise tool is stopped on a use surface such as a paved surface or a floor surface.

(1) An exercise tool according to the present invention includes: a base having a contact part that is in contact with a use surface; a movable part magnetically and detachably held above the base; a three-dimensionally movable support unit configured to support the movable part that is held by the base, in such a manner as to allow the movable part to move three-dimensionally and flexibly; and an attachment part via which the movable part is detachably attachable to a hand or a foot in a direct or indirect manner. The use surface herein is not limited to the ground outdoors. In the outdoors, the use surface may be a paved surface or the like, for example. In the indoors, the use surface may be a floor surface or the like, for example. The contact part herein can be formed in the shape of a point, a line, or a plane in a three-dimensional view. For example, in a case where the use surface is a geometric plane and a complete solid body and the contact part are a complete sphere, the contact part is formed in the shape of a point.

(2) In the configuration of (1), the three-dimensionally movable support unit may include a spherical-surface shaft provided to one of the base and the movable part and a recessed-surface bearing provided to another one of the base and the movable part and designed to be slidably fitted to the spherical-surface shaft.

(3) In the configuration of (1) or (2), the base may include a sliding unit configured to enable the contact part to glide over the use surface.

(4) In the configuration of (3), the sliding unit may include a ball bearing configured to work as a contact point with respect to the use surface.

(5) In the configuration of (3) or (4), the base may include the sliding unit and a base body, and the sliding unit may be detachably attached to the base body.

(6) The configuration of any one of (1) to (5) may include an elastic member coupling the base and the movable part to each other, the elastic member being configured to buffer movement of the movable part and to restore a relative position of the movable part with respect to the base to a reference position.

(7) In the configuration of (6), the elastic member may be magnetically and detachably held by both the base and the movable part in a slidable manner around a predetermined center axis line defined in the base.

According to the present invention, it is possible to provide an exercise tool that enables wide variations in exercises and muscle training even while the exercise tool is stopped on the use surface such as a paved surface or a floor surface.

BRIEF DESCRIPTION OF THE DRAWINGS

FIG. 9A is a front view, and FIG. 9B is a back view;

FIG. 10A is a front view, and FIG. 10B is a back view;

DETAILED DESCRIPTION OF THE INVENTION

Figure 1:
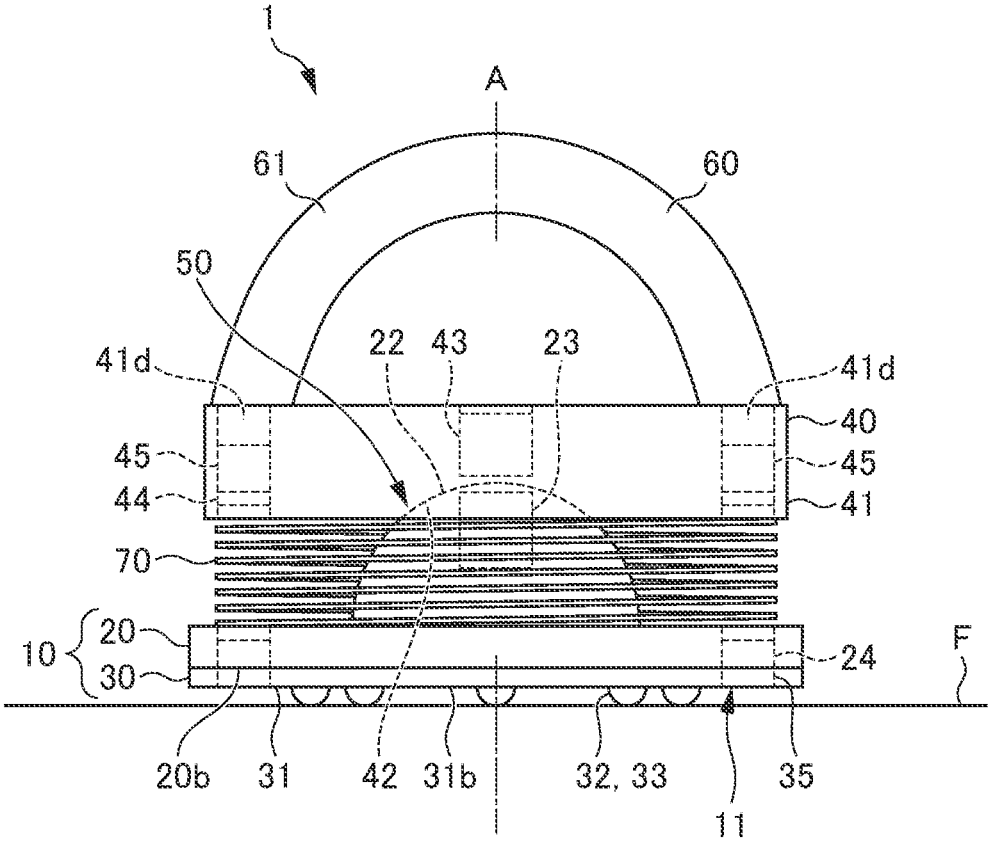
FIG. 1 is a side view showing an exercise tool according to one embodiment of the present invention.
Figure 2:
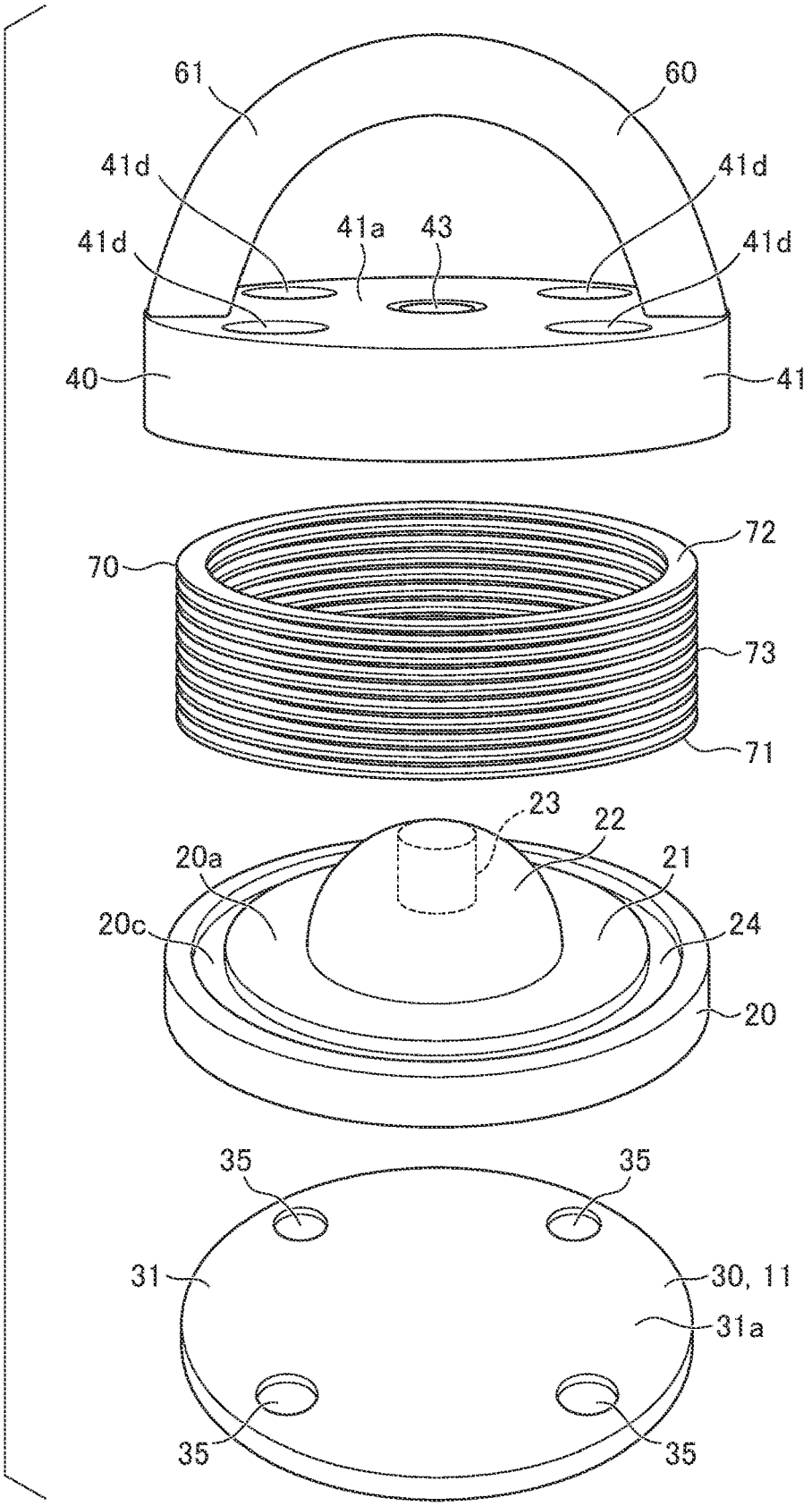
FIG. 2 is an exploded perspective view of the exercise tool according to the one embodiment, viewed from the top.
Figure 3:
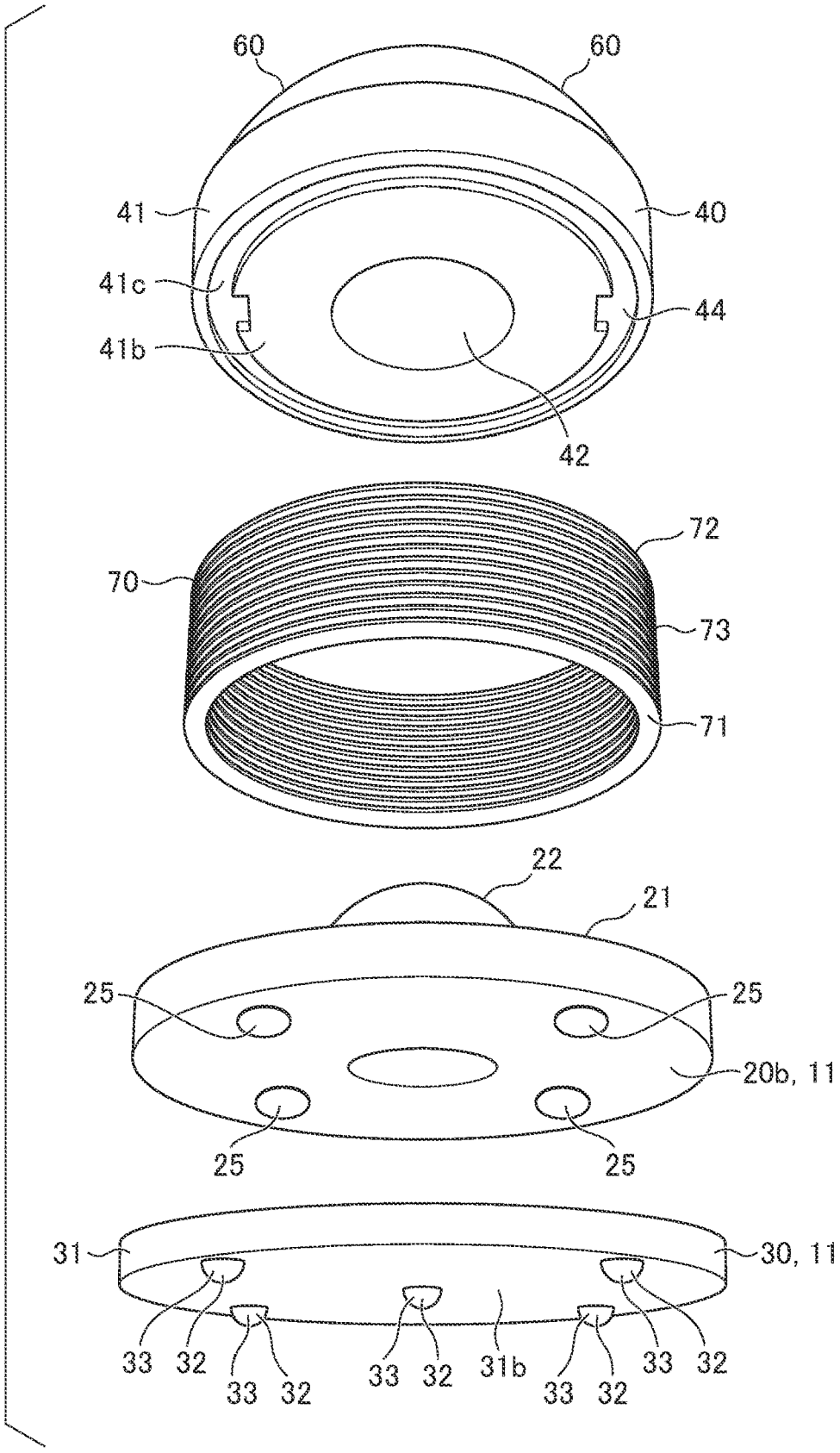
FIG. 3 is an exploded perspective view of the exercise tool according to the one embodiment, viewed from the bottom.

The following will describe one embodiment of the present invention with reference to the drawings. FIGS. 1 to 3 show an exercise tool 1 according to the one embodiment. As shown in FIG. 1, the exercise tool 1 includes a base 10 including a contact part 11 that is in contact with a use surface F, a movable part 40, a three-dimensionally movable support unit 50, an attachment part 60, and a coil spring 70.

The exercise tool 1 according to the present embodiment is for use in an outdoor or indoor space. Examples of the outdoor space encompass a park and an open space. The use surface F in the outdoor space may be a ground surface or a paved surface, for example. Examples of the indoor space encompass a workout room, an exercise studio, and a gym. The use surface F in the indoor space may be a floor surface, for example. Thus, the use surface F (i.e., contact target surface) with which the contact part 11 of the exercise tool 1 of the present embodiment comes into contact is not limited to the ground surface in the outdoor space, but may alternatively be the paved surface or floor surface, as described above.

The base 10 includes a base body 20 and a sliding plate 30 detachably attached to the base body 20. As shown in FIG. 2, the base body 20 includes a support plate 21 shaped in a disc, a spherical-surface shaft 22 provided in a center part of an upper surface of the support plate 21, and a first magnet 23. As will be described later, the spherical-surface shaft 22 constitutes the three-dimensionally movable support unit 50. The spherical-surface shaft 22 has a spherical upper surface. The spherical-surface shaft 22 is integrated with the base body 20, and protrudes upward from an upper surface of the base body 20. As shown in FIG. 1, the apex of the spherical-surface shaft 22 is located on a center axis line A, which passes through the center of the base body 20. The first magnet 23, which is buried in the spherical-surface shaft 22, is a permanent magnet. The first magnet 23 and a fourth magnet 43 of the movable part 40 attract each other. The center axis line A is one example of the predetermined center axis line defined in the base of the present invention.

As shown in FIGS. 2 and 3, the base body 20 further includes a lower ring 24 and four second magnets 25. The lower ring 24 has a feature of magnetically holding a lower end part of the coil spring 70. The lower ring 24 is constituted by an annular plate material made of a metal (e.g., iron, stainless steel) having magnetic properties. The lower ring 24 is fixed by being fitted into an annular groove 20*c*, which is provided along the outer periphery of the upper surface 20*a* of the base body 20. The lower ring 24 is arranged coaxially with the base body 20.

The second magnets 25 have a feature of detachably coupling the base body 20 and the sliding plate 30 to each other and a feature of imparting magnetic force to the lower ring 24. As shown in FIG. 3, the second magnets 25 are arranged circumferentially at equal intervals along the outer periphery of a lower surface 20*b* of the base body 20. The second magnets 25 are buried in the base body 20 such that lower surfaces of the second magnets 25 are exposed. The exposed surfaces of the second magnets 25 form a plane continuous with the lower surface 20*b* of the base body 20. Alternatively, the exposed surfaces of the second magnets 25 may be slightly recessed relative to the lower surface 20*b*. The second magnets 25 are disposed close to the lower ring 24, so as to impart magnetic force to the lower ring 24. The number of second magnets 25 is not limited to four, but may be arbitrarily set. For example, the number of second magnets 25 may be two, three, or five or more.

The contact part 11 includes the lower surface 20*b* of the base body 20 and the sliding plate 30. Each of the lower surface 20*b* of the base body 20 and the sliding plate 30 is one example of the sliding unit of the present invention. The sliding plate 30 is detachably attached to the lower surface 20*b* of the base body 20. The sliding plate 30 includes a bottom plate 31 detachably attached to the lower surface 20*b* of the base body 20, five ball bearings 32 provided to a lower surface 31*b* of the bottom plate 31, and four third magnets 35 exposed from an upper surface 31*a* of the bottom plate 31.

The bottom plate 31 is a disc-shaped member having an outer diameter substantially identical to that of the base body 20, and is arranged substantially coaxially with the base body 20.

As shown in FIG. 3, the ball bearings 32 each have a bearing (not shown) fixed to the circular lower surface 31*b* of the bottom plate 31 and a ball 33 rotatably supported by the bearing. Each ball 33 provides a contact point with respect to the use surface F. The ball bearings 32 are arranged at one location at a center part of the lower surface 31*b* of the bottom plate 31 and four locations arranged circumferentially at equal intervals along the outer periphery of the lower surface 31*b* of the bottom plate 31.

The ball bearings 32 are disposed in the bottom plate 31 such that parts of the balls 33 slightly protrude downward from the lower surface 31*b* of the bottom plate 31. The balls 33 protrude from the lower surface 31*b* in equal amounts. Thus, all the balls 33 are rotatably in contact with the use surface F. In this state, the whole of the base 10 is substantially in parallel with the use surface F. The sliding plate 30 of the present embodiment has five ball bearings 32. However, the number of ball bearings 32 is not limited to five, and may arbitrarily be set.

The third magnets 35 and the second magnets 25 of the base body 20 attract each other. The third magnets 35 have a feature of detachably coupling the base body 20 and the sliding plate 30 to each other. The four third magnets 35 are arranged circumferentially at equal intervals along the outer periphery of the lower surface 31*b* of the bottom plate 31. The third magnets 35 are positioned so as to face their respective second magnets 25 in a state where the bottom plate 31 is arranged substantially coaxially with the base body 20.

The base 10 is achieved by attaching the sliding plate 30 to the base body 20. Specifically, the sliding plate 30 is disposed such that its bottom plate 31 faces the lower surface 20*b* of the base body 20 coaxially with each other, so that the second magnets 25 and the third magnets 35 magnetically attract each other. In the base 10, the center axis line A is substantially orthogonal to the lower surface 31*b* of the bottom plate 31. In order to detach the bottom plate 31 from the base body 20, the bottom plate 31 is separated from the base body 20 against the attractive force (magnetic force) between the second magnets 25 and the third magnets 35.

The movable part 40 is magnetically and detachably held above the base 10. The movable part 40 includes a movable plate 41 being shaped in a disc and having an outer diameter substantially identical to those of the base body 20 and the bottom plate 31, a recessed-surface bearing 42 provided in a center part of a lower surface 41*b* of the movable plate 41, the fourth magnet 43, an upper ring 44, and four fifth magnets 45. As will be described later, the recessed-surface bearing 42 constitutes the three-dimensionally movable support unit 50. The recessed-surface bearing 42 is a recess designed to be slidably fitted to the spherical-surface shaft 22 of the base body 20. The fourth magnet 43, which is buried in a center part of the movable plate 41, is a permanent magnet. The fourth magnet 43 and the first magnet 23 of the base 10 attract each other.

The upper ring 44 makes a pair with the above-described lower ring 24. The upper ring 44 has a feature of magnetically holding an upper end part of the coil spring 70. Similar to the lower ring 24, the upper ring 44 is constituted by an annular plate material made of a metal (e.g., iron, stainless steel) having magnetic properties. The upper ring 44 is fixed by being fitted into an annular groove 41*c* provided along the outer periphery of the lower surface 41*b* of the movable plate 41. The upper ring 44 is arranged coaxially with the movable plate 41.

The fifth magnets 45 are made of permanent magnets. The fifth magnets 45 are buried at four locations arranged circumferentially at equal intervals along the outer periphery of the movable plate 41. In the present embodiment, the fifth magnets 45 are respectively fixed to the bottoms of recesses 41*d* provided along the outer periphery of the upper surface 41*a* of the movable plate 41. The fifth magnets 45 are disposed close to the upper ring 44, and have a feature of imparting magnetic force to the upper ring 44.

The movable part 40 is configured such that, when the recessed-surface bearing 42 is brought closer to the spherical-surface shaft 22 of the base body 20, the fourth magnet 43 and the first magnet 23 attract each other, and the recessed-surface bearing 42 is slidably fitted to the spherical-surface shaft 22, so that the movable part 40 is attached to the base 10. In order to detach the movable part 40 from the base 10, the recessed-surface bearing 42 is separated from the spherical-surface shaft 22 against the attractive force (magnetic force) between the fourth magnet 43 and the first magnet 23.

The three-dimensionally movable support unit 50 supports the movable part 40, which is magnetically and detachably held above the base 10, in such a manner as to allow the movable part 40 to move three-dimensionally and flexibly. As described above, the three-dimensionally movable support unit 50 of the present embodiment includes the spherical-surface shaft 22 provided to the base body 20 of the base 10 and the recessed-surface bearing 42 provided to the movable part 40. The depth of the recessed-surface bearing 42 is smaller than the height of the spherical-surface shaft 22. The spherical-surface shaft 22 is partially fitted into the recessed-surface bearing 42 in a slidable manner. This creates a space between the base body 20 and the movable plate 41. This allows the movable part 40 to move three-dimensionally in a flexible manner.

Figure 4:
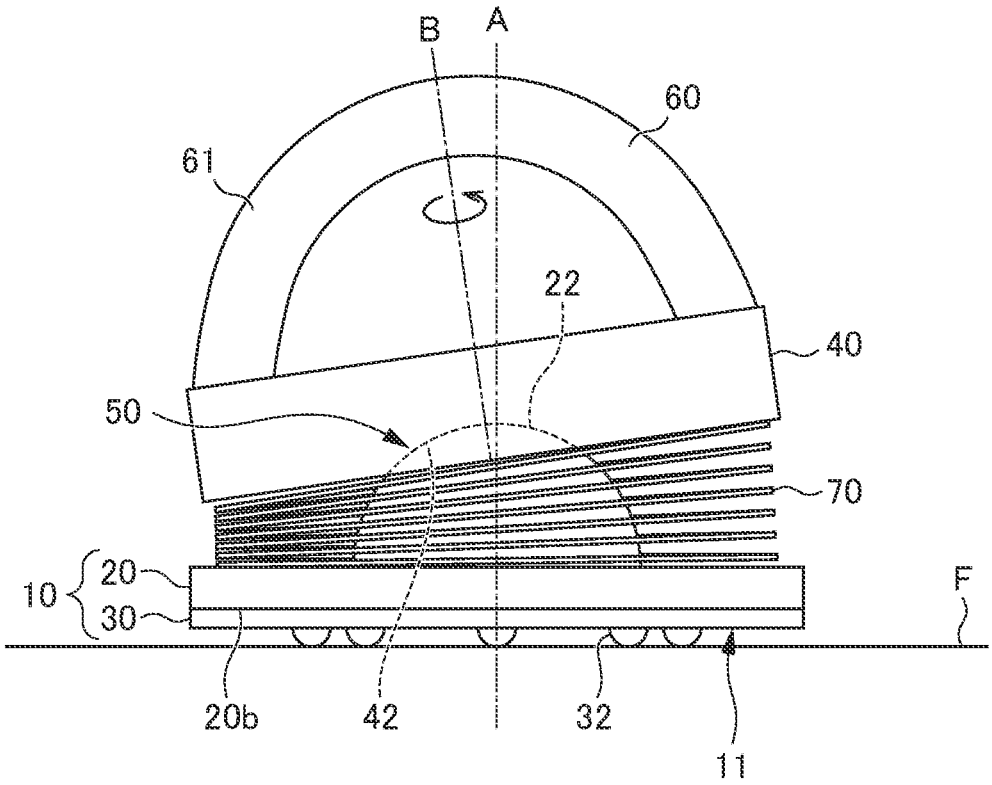
FIG. 4 is a side view of the exercise tool according to the one embodiment, where a movable part is tilted.

The three-dimensional movement of the movable part 40, which is enabled by the sliding of the recessed-surface bearing 42 of the movable part 40 over the spherical-surface shaft 22 of the base body 20, may be "turning" of the movable part 40 by 360° about a center axis line B of the movable part 40, "tilting" of the movable part 40 with its center axis line B tilted with respect to the center axis line A of the base 10, or "revolving" of the movable part 40 with its center axis line B tilted and turned by 360°, as shown in FIG. 4. A user of the exercise tool 1 can move the movable part 40 on the base 10 in these three patterns.

Via the attachment part 60, the movable part 40 is detachably attachable to the foot or hand in a direct manner. Via the attachment part 60, the movable part 40 is detachably attachable to the foot or hand in an indirect manner. The "indirect manner" herein includes a case where a shoe or a glove that the user wears on his/her foot or hand is detachably attached to the attachment part, for example.

The attachment part 60 of the present embodiment includes a band 61 provided to the movable part 40. The band 61 has two opposed ends engaged with the outer periphery of the movable part 40. Consequently, the band 61 is disposed above the movable part 40 in an arch shape. For example, in order to wear the movable part 40 on a foot, the foot is inserted into a space between the band 61 and the movable part 40, and the foot is sandwiched therebetween while the instep is in contact with the band 61. Consequently, the movable part 40 can be attached to the foot. Preferably, the band 61 is designed to have an adjustable length (the band 61 with elasticity is also preferable), since such a band 61 can be adjusted to fit the size of the foot or hand and can suitably tighten the foot or hand to give reliable attachment.

The coil spring 70 is one example of the elastic member of the present invention. Specifically, the coil spring 70 couples the base 10 and the movable part 40 to each other. The coil spring 70 is configured to buffer movement of the movable part 40 and to restore the relative position of the movable part 40 with respect to the base 10 to a reference position. The coil spring 70 is magnetically and detachably held by both the base 10 and the movable part 40 in a slidable manner around the center axis line A of the base 10 substantially orthogonal to the lower surface 31*b* of the bottom plate 31. For this, the coil spring 70 is constituted by a metal (e.g., iron, stainless steel) having magnetic properties.

The coil spring 70 is substantially identical in diameter to the above-described lower ring 24 and upper ring 44. As shown in FIGS. 2 and 3, the coil spring 70 has a lower-end ring part 71, an upper-end ring part 72, and a spring part 73 interposed between the lower-end ring part 71 and the upper-end ring part 72. At a location between the base 10 and the movable part 40, the coil spring 70 is disposed in a state where the coil spring 70 slightly extends from a load-free, natural condition, for example.

The coil spring 70 is configured such that the lower-end ring part 71 is in slidable contact with an upper surface of the lower ring 24 of the base 10 and the upper-end ring part 72 is in slidable contact with a lower surface of the upper ring 44 of the movable part 40. The lower-end ring part 71 is attracted to the lower ring 24, to which magnetic force is imparted by the second magnets 25. Meanwhile, the upper-end ring part 72 is attracted to the upper ring 44, to which magnetic force is imparted by the fifth magnets 45. The "attracting" herein refers to one mode of coupling, fixing, or holding.

In the state where the coil spring 70 is attached in the above-described manner, the movable plate 41 of the movable part 40 is held substantially in parallel with the base body 20 of the base 10 by tensile force of the coil spring 70. The state where the movable plate 41 is substantially in parallel with the base body 20 corresponds to the above-described reference position. It should be noted that the reference position is arbitrarily set. The reference position does not need to be a strictly set one. The reference position may have a certain degree of margin that is determined according to the tensile force of the coil spring 70 and/or the like.

The movable part 40 is three-dimensionally movable in a state where the movable part 40 is coupled to the base 10 via the coil spring 70. When the movable part 40 is tilted, the coil spring 70 is partially compressed in the tilting direction. When the tilting is released, the coil spring 70 returns to its original condition, so that the movable part 40 is restored to the reference position.

The foregoing has explained the configuration of the exercise tool 1 according to the present embodiment. Next, the following will describe an example of usage of the exercise tool 1. The exercise tool 1 is used in a state where a user wears the exercise tool 1 on his/her feet or hands.

(1) When Exercise Tool is Attached to User's Feet During Use

Figure 5:
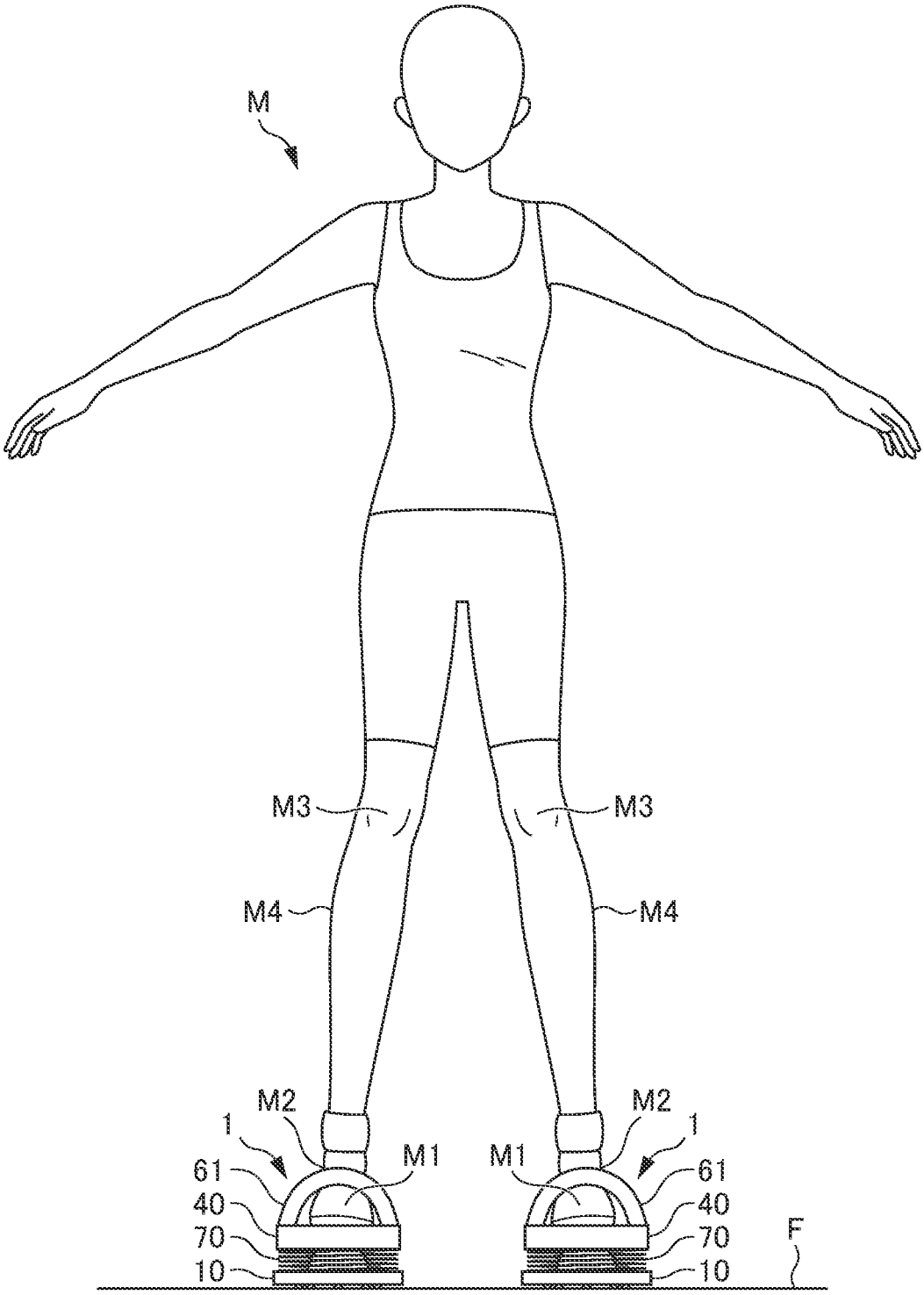
FIG. 5 is a view showing a state where a user is standing while wearing the exercise tool according to the one embodiment on his/her feet.
Figure 6:
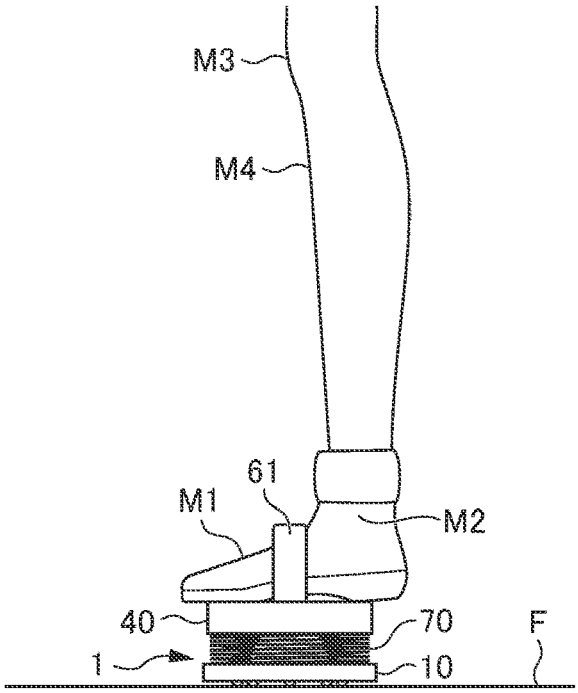
FIG. 6 is a side view of the feet to which the exercise tool according to the one embodiment is attached.
Figure 7:
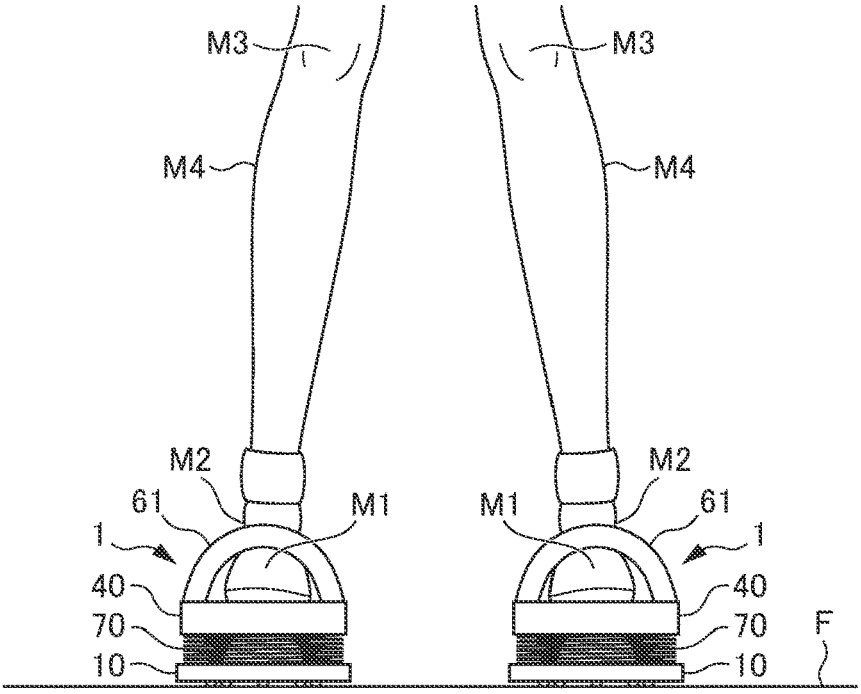
FIG. 7 is a front view of the feet to which the exercise tool according to the one embodiment is attached.

FIG. 5 shows a state where a user M wearing the exercise tool 1 on his/her feet M1 stands on a use surface F. By inserting the feet M1 into spaces between the movable parts 40 and the bands 61 in the manner shown in FIGS. 6 and 7, the exercise tool 1 is attached to the feet M1. The exercise tool 1 supports the user M with the balls 33 of the ball bearings 32 that are rotatably in contact with the use surface F.

(1-1) When Exercise Tool is Stopped During Use

For example, when the user M moves his/her body and limbs to bend and/or turn the ankles M2 while standing on the use surface F without moving over the use surface F, the motion of the ankles M2 causes at least one movement of turning, tilting, and revolving of the movable parts 40.

During an exercise, the user M feels, with his/her feet M1, sliding of the recessed-surface bearings 42 of the movable parts 40 over the spherical-surface shafts 22 of the bases 10. While feeling the sliding and/or unstable three-dimensional movement of the movable parts 40, the user M performs an exercise of bending or turning the ankles M2. The user M may actively move the body and limbs so as to move the movable parts 40 in various patterns, the movable parts 40 being movable three-dimensionally. In this manner, the user M can perform an exercise and/or muscle training while moving the ankles M2 and a part of or the whole of the body and limbs in various ways. Thus, the exercise tool enables wide variations in exercises and muscle training in the state where the exercise tool is stopped on the use surface F.

For example, while standing on one leg, the user M can turn his/her entire body so as to turn the movable part(s) 40. For another example, while flexing and extending the knees M3, the user may flex and extend the ankles M2 in various directions by tilting the movable parts 40. In this case, the ankles M2 can move in a range wider than that in a case where the user flexes and extends the ankles M2 while standing with the feet M1 placed directly on the use surface F. Thus, a load can be applied to various parts of the body and limbs, thereby enabling a training of multiple muscles. The movable parts 40 are three-dimensionally movable according to the movement of the body and limbs, and the movement pattern is hardly disturbed.

Meanwhile, when the user M tries to stop on the movable parts 40, the movable parts 40 slightly move unsteadily due to a very small motion of the body and limbs transmitted thereto. The user M may try to regain the original posture against the movement of the movable parts 40. Through this motion, the user M can perform a static muscle training.

Since the balls 33 of the ball bearings 32 are rotatably in contact with the use surface F, the exercise tool 1 may sometimes move from one position to another during an exercise or muscle training. Through a motion for moving the exercise tool 1 back to the original position or a motion for causing the exercise tool 1 to slide to an arbitrary position, the user can also perform muscle training.

The exercise tool 1 can be used in a state where the sliding plate 30 is detached from the base body 20. In this case, the lower surface 20*b* of the base body 20 comes into direct contact with the use surface F. In this state, the exercise tool 1 is stopped more stably, as compared to the case where the exercise tool 1 is stopped with the balls 33 of the ball bearings 32 being in contact with the use surface F. Therefore, the user can perform an exercise and/or muscle training without being affected by sliding of the exercise tool 1.

(1-2) when Exercise Tool is Caused to Slide During Use

Figure 8:
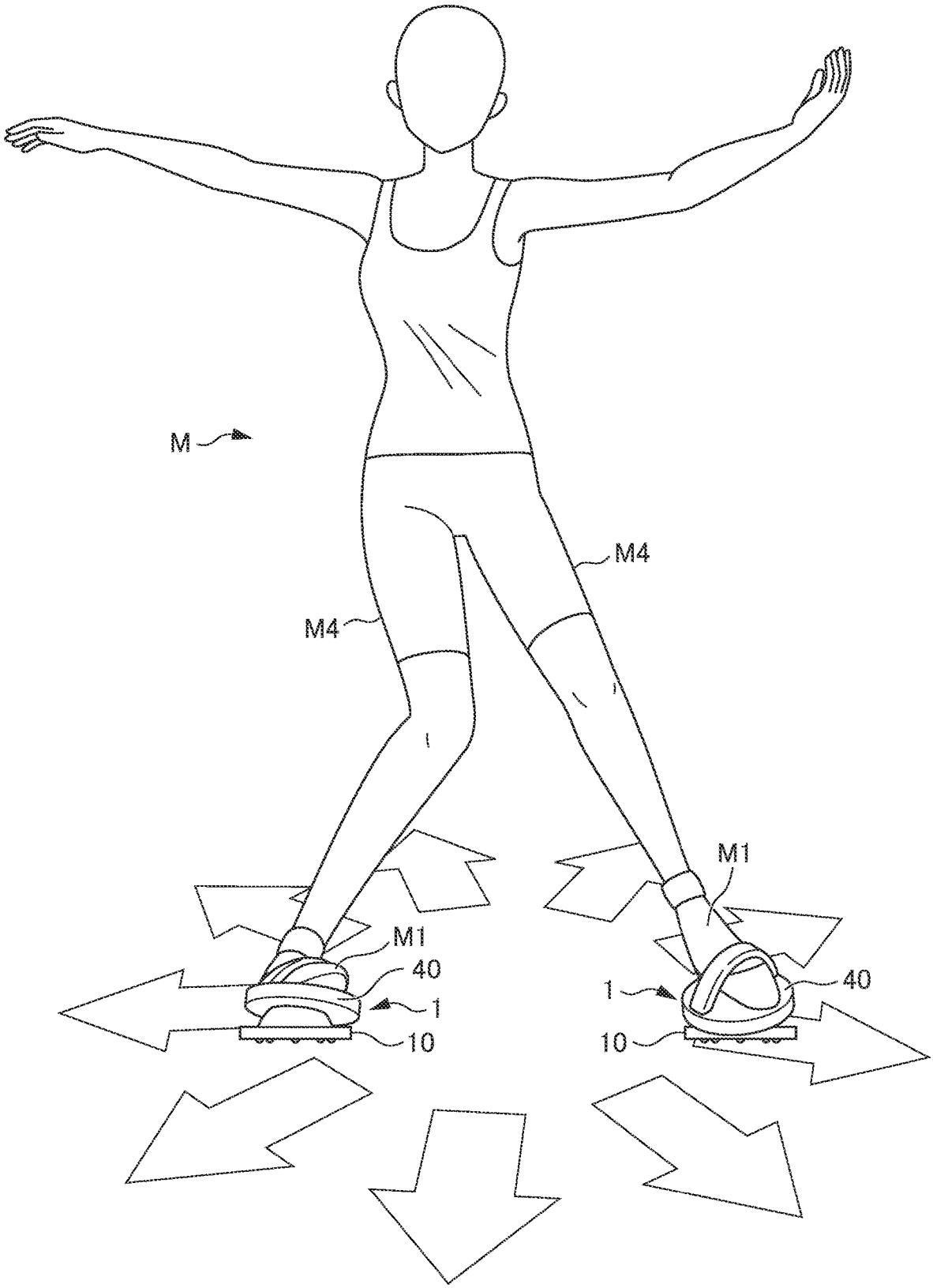
FIG. 8 is a view showing a state where the user opens his/her legs while wearing the exercise tool according to the one embodiment.

By moving his/her body and limbs so as to glide over the use surface F, the user M can cause the exercise tool 1 to slide on the use surface F as a result of rolling of the balls 33 of the ball bearings 32. As shown in FIG. 8, the user M who is standing may open both of or one of the legs M4 in various directions, such as a front-back direction, a left-right direction, and/or a diagonal direction, by causing the exercise tool 1 to slide. In this manner, the user can perform muscle training for giving a load on the legs M4 and/or a performance such as a dance.

Figure 9A:
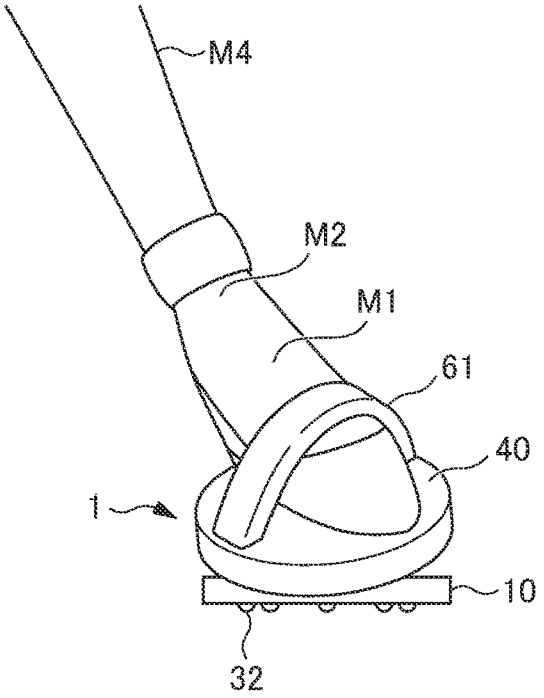
FIGS. 9A and 9B show a state where the user bends and tilts the ankle of his/her left leg forward while wearing the exercise tool according to the one embodiment.
Figure 9B:
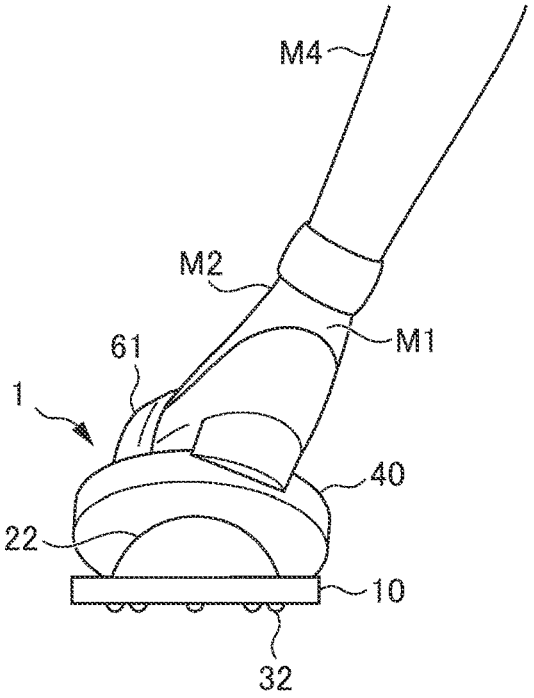
Figure 10A:
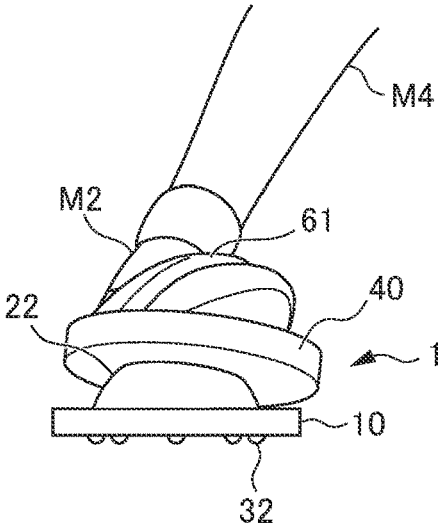
FIGS. 10A and 10B show a state where the user bends and tilts the ankle of his/her left leg backward while wearing the exercise tool according to the one embodiment.
Figure 10B:
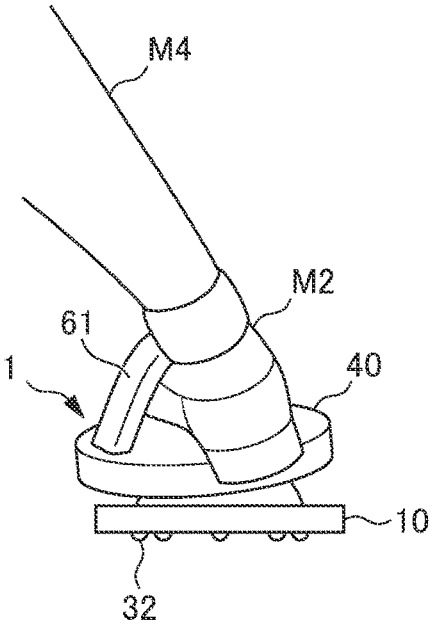

The user M can turn the ankle M2 in circles so as to revolve the movable part 40. FIGS. 9A, 9B, 10A and 10B each show such a turning motion of the ankle M2. FIGS. 9A and 9B show a state where the user bends and tilts the ankle M2 of the left foot M1 forward, whereas FIGS. 10A and 10B show a state where the user leans and tilts the ankle M2 of the left foot M1 backward. Following the bending of the ankle M2, the movable part 40 moves three-dimensionally. This reduces the load on the ankle M2, and expands the range in which the ankle M2 can bend. This increases the variations in exercises and muscle training. Additionally, a recreational element is attained. FIGS. 8 to 10 do not show the coil spring 70 for clear illustration of movement of the movable part 40.

With the exercise tool 1, instead of staying at a certain location on the use surface F, the user M can glide over the use surface F to move forward, backward, leftward, rightward, or diagonally by causing the balls 33 of the ball bearings 32 to roll. The user M may move the ankles M2 to turn, tilt, or revolve the movable parts 40. With this, the user can perform the above-described exercise, muscle training, performance (e.g., a dance), or the like, while gliding over the use surface.

In a case where a use surface F having been made slippery is employed, the sliding plate 30 may not be used. More specifically, the exercise tool 1 can glide in a state where the lower surface 20*b* of the base body 20 from which the sliding plate 30 is detached is in direct contact with the use surface F. That is, in this case, the lower surface 20*b* of the base body 20 corresponds to the sliding unit. Therefore, it is preferable to adopt the lower surface 20*b* of the base body 20 that has been processed to achieve high smoothness and high slipperiness.

(2) When Exercise Tool is Attached to User's Hands During Use

Figure 11:
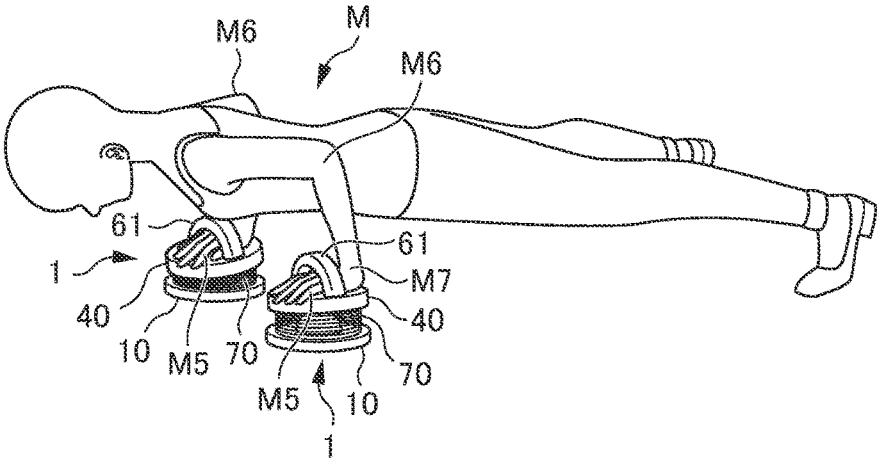
FIG. 11 shows a state where the user is lying face down while wearing the exercise tool according to the one embodiment on his/her hands, viewed diagonally from the front.

As shown in FIG. 11, the user M can use the exercise tool 1 while lying face down with his/her hands M5 wearing the exercise tool 1 and the exercise tool 1 being in contact with the use surface F. By inserting the hands M5 into spaces between the movable plates 41 of the movable parts 40 and the bands 61, the exercise tool 1 is attached to the hands M5. The exercise tool 1 supports the user M with the balls 33 of the ball bearings 32 that are rotatably in contact with the use surface F.

As shown in FIG. 11, the user M lying face down may open both of or one of the arms M6 in various directions, such as the front-back direction, the left-right direction, and/or the diagonal direction, by causing the exercise tool 1 to slide. In this manner, the user can perform muscle training by applying a load on the arms M6.

Figure 12:
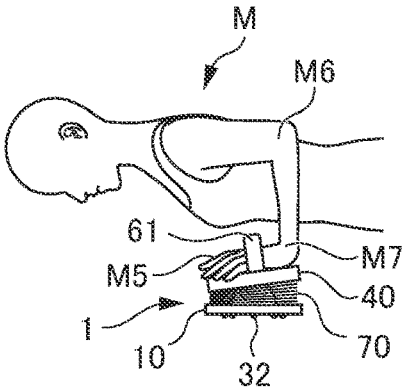
FIG. 12 is a view showing a case where the user tilts the movable part forward in the state shown in FIG. 11.
Figure 13:
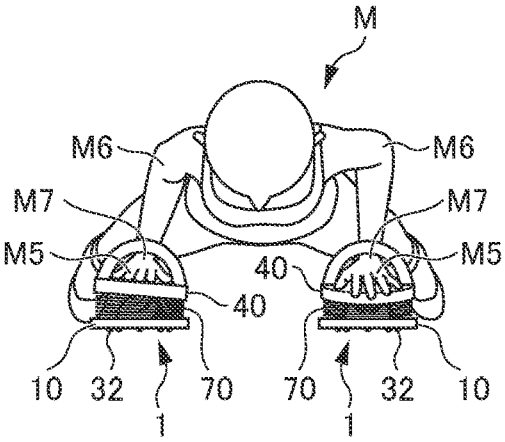
FIG. 13 is a view showing a case where the user tilts the movable part medially in the state shown in FIG. 11.

In addition, the user M can do push-ups while turning his/her wrists M7 so as to turn, tilt, or revolve the movable parts 40. The user can bend the wrists M7 forward by tilting the movable parts 40 forward as shown in FIG. 12, whereas the user can bend the wrist M7 of the right hand medially by tilting the movable part 40 medially as shown in FIG. 13. The user can three-dimensionally turn the wrists M7 together with the movable parts 40. In this case, the wrists M7 can bend in a range wider than that in a case where the user performs an exercise or muscle training while placing the hands M5 directly on the use surface F. This enables a wide variety of exercises and muscle trainings.

The above-described patterns of usage are merely examples of the usage of the exercise tool 1 according to the present embodiment. The exercise tool 1 can be used in other various ways.

The following will describe the effects of the exercise tool 1 according to the present embodiment. The exercise tool 1 according to the present embodiment includes: the base 10 having the contact part 11 that is in contact with the use surface F; the movable part 40 magnetically and detachably held above the base 10; the three-dimensionally movable support unit 50 configured to support the movable part 40 that is held by the base 10, in such a manner as to allow the movable part 40 to move three-dimensionally and flexibly; and the attachment part 60 via which the movable part 40 is detachably attachable to a hand or a foot in a direct or indirect manner.

With this, even while the exercise tool 1 is stopped on the use surface F, the user M of the exercise tool 1 can perform wide variations in exercises and muscle training.

The exercise tool 1 according to the present embodiment is configured such that the three-dimensionally movable support unit 50 includes the spherical-surface shaft 22 provided to the base 10 and the recessed-surface bearing 42 provided to the movable part 40 and designed to be slidably fitted to the spherical-surface shaft 22.

With this, the exercise tool 1 achieves a simple structure capable of reliably supporting the movable part 40 at the base 10 in such a manner as to allow the movable part 40 to move three-dimensionally and flexibly.

The exercise tool 1 according to the present embodiment is configured such that the base 10 includes, as the sliding unit configured to enable the contact part 11 to glide over the use surface F, the sliding plate 30 and the lower surface 20*b* of the base body 20.

With this, the user of the exercise tool 1 can move while gliding over the use surface F via the sliding plate 30 or the lower surface 20*b* of the base body 20. Thus, the user can perform an exercise, a training, or the like while moving over the use surface.

The exercise tool 1 according to the present embodiment includes, as the sliding unit, the sliding plate 30 including the ball bearings 32 configured to work as contact points with respect to the use surface F.

With this, the exercise tool 1 can move over the use surface F smoothly via the ball bearings 32.

The exercise tool 1 according to the present embodiment is configured such that the base 10 includes the sliding plate 30 and the base body 20, which constitute the sliding unit, and the sliding plate 30 is detachably attached to the base body 20.

With this, the exercise tool 1 can be used in either of a mode in which the exercise tool 1 is movable with the sliding plate 30 attached to the base body 20 and a mode in which the exercise tool 1 is stopped with the sliding plate 30 detached from the base body 20. This enables wider varieties of exercises and muscle training.

The exercise tool 1 according to the present embodiment includes the coil spring 70 coupling the base 10 and the movable part 40 to each other, the coil spring 70 being configured to buffer movement of the movable part 40 and to restore the relative position of the movable part 40 with respect to the base 10 to the reference position.

In the exercise tool 1 configured as above, when the movable part 40 is tilted by the hand or foot via the coil spring 70, the coil spring 70 is compressed to buffer the movement of the movable part 40. Meanwhile, the tensile force of the coil spring 70 acts to restore the movable part 40 to the reference position, and the force for restoration is transmitted to the hand or foot. While feeling the tensile force of the coil spring 70, the user can achieve a favorable feeling of use. In addition, the user can bring the movable part 40 back to the reference position by a slight force.

The exercise tool 1 according to the present embodiment is configured such that the coil spring 70 is magnetically and detachably held by both the base 10 and the movable part 40 in a slidable manner around the center axis line A substantially orthogonal to the lower surface 31*b* of the bottom plate 31.

In the exercise tool 1 configured as above, the movable part 40 can freely turn 360° relative to the base 10, while the coupling between the base 10 and the movable part 40 is maintained by the coil spring 70. Thus, even if the movable part 40 is separated from the base 10 accidentally, the movable part 40 would be pulled back to the base 10 by the coil spring 70, and the movable part 40 can be kept and held by the base 10.

The foregoing has explained one embodiment of the present invention. However, the present invention is not limited to the above-described embodiment, but may be implemented in various modes.

For example, the movable part 40 may be integrated with a shoe or a glove, and the shoe or glove integrally including the movable part 40 may be magnetically held at the base body 20 of the base 10. In this case, the movable part 40 is attached to the user's foot or hand in an indirect manner. In other words, the movable part 40 may be shoe-shaped and have features of a shoe. Alternatively, the movable part 40 may be glove-shaped and have features of a glove. In contrast with the above-described embodiment, the spherical-surface shaft 22 and the recessed-surface bearing 42, which constitute the three-dimensionally movable support unit 50, may be configured such that the spherical-surface shaft 22 is provided to the movable part 40 and the recessed-surface bearing 42 is provided to the base 10. However, it is preferable that the spherical-surface shaft 22 be provided to the base 10 and the recessed-surface bearing 42 be provided to the movable part 40 as in the above-described embodiment, since this configuration can more stably support the load applied by the user M.

The sliding unit of the present invention may not be detachably attached to the base body 20. Alternatively, the sliding unit may be fixedly provided to the base body 20. The fixedly-provided sliding unit can be achieved by directly providing the ball bearings 32 to the lower surface 20*b* of the base body 20, for example. The base 10 may not include the sliding unit, but may include only the base body 20. In this case, the lower surface 20*b* of the base body 20 comes into direct contact with the use surface F, and the user performs an exercise or muscle training by moving the movable part 40 while the exercise tool 1 is stopped. The coil spring 70 is constituted by a metal having magnetic properties. The purpose of this is to hold the coil spring 70 by causing the coil spring 70 to magnetically attract the lower ring 24 of the base 10 and the upper ring 44 of the movable part 40. Alternatively, at least the lower-end ring part 71, which comes into contact with the lower ring 24, and the upper-end ring part 72, which comes into contact with the upper ring 44, may be constituted by a metal having magnetic properties. In this case, the spring part 73 may be made of a resin or the like.

EXPLANATION OF REFERENCE NUMERALS

1 exercise tool
10 base
11 contact part
20 base body
20*b* lower surface of base body (sliding unit)
22 spherical-surface shaft
30 sliding plate (sliding unit)
32 ball bearing
40 movable part
42 recessed-surface bearing
50 three-dimensionally movable support unit
60 attachment part
70 coil spring (elastic member)
A center axis line
F use surface
M1 foot
M5 hand

What is claimed is:

1. An exercise tool comprising: a base having a contact part that is in contact with a use surface;

a movable part magnetically and detachably held above the base;

a three-dimensionally movable support unit configured to support the movable part that is held by the base, in such a manner as to allow the movable part to move three-dimensionally and flexibly; and an attachment part via which the movable part is configured to be detachably attachable to a hand or a foot in a direct or indirect manner.

2. The exercise tool according to claim 1, wherein the three-dimensionally movable support unit includes a spherical-surface shaft provided to one of the base and the movable part and a recessed-surface bearing provided to another one of the base and the movable part and designed to be slidably fitted to the spherical-surface shaft.

3. The exercise tool according to claim 1, wherein the base includes a sliding unit configured to enable the contact part to glide over the use surface.

4. The exercise tool according to claim 3, wherein the sliding unit includes a ball bearing configured to work as a contact point with respect to the use surface.

5. The exercise tool according to claim 3, wherein the base includes the sliding unit and a base body, and the sliding unit is detachably attached to the base body.

6. The exercise tool according to claim 1, further comprising an elastic member coupling the base and the movable part to each other, the elastic member being configured to buffer movement of the movable part and to restore a relative position of the movable part with respect to the base to a reference position.

7. The exercise tool according to claim 6, wherein the elastic member is magnetically and detachably held by both the base and the movable part in a slidable manner around a predetermined center axis line defined in the base.

* * * * *